US009284758B2

(12) United States Patent
Yokomori et al.

(10) Patent No.: US 9,284,758 B2
(45) Date of Patent: Mar. 15, 2016

(54) OPERATING DEVICE FOR A VEHICLE DOOR LATCH

(71) Applicant: Mitsui Kinzoku Act Corporation, Kanagawa (JP)

(72) Inventors: Kazuhito Yokomori, Kanagawa (JP); Kohei Yamashita, Kanagawa (JP)

(73) Assignee: Mitsui Kinzoku Act Corporation (JP)

( * ) Notice: Subject to any disclaimer, the term of this patent is extended or adjusted under 35 U.S.C. 154(b) by 321 days.

(21) Appl. No.: 13/927,289

(22) Filed: Jun. 26, 2013

(65) Prior Publication Data

US 2014/0001778 A1 Jan. 2, 2014

(30) Foreign Application Priority Data

Jun. 28, 2012 (JP) ..... 2012-145835
Jun. 28, 2012 (JP) ..... 2012-145836

(51) Int. Cl.

| | |
|---|---|
| ***E05C 3/06*** | (2006.01) |
| ***E05B 83/40*** | (2014.01) |
| ***E05B 85/10*** | (2014.01) |
| ***E05B 81/64*** | (2014.01) |
| ***E05B 81/76*** | (2014.01) |
| ***E05B 83/04*** | (2014.01) |
| *E05C 3/16* | (2006.01) |

(52) U.S. Cl.

CPC ..... *E05B 83/40* (2013.01); *E05B 81/64* (2013.01); *E05B 81/76* (2013.01); *E05B 83/04* (2013.01); *E05B 85/10* (2013.01); *Y10T 292/57* (2015.04)

(58) Field of Classification Search

CPC ..... E05B 85/10; E05B 83/02; E05B 83/04; E05B 83/40; E05B 81/64; E05B 81/76

USPC ..... 292/201, 216, DIG. 23, DIG. 46, 336.3; 49/279, 280, 324, 339, 340, 360, 503

See application file for complete search history.

(56) References Cited

U.S. PATENT DOCUMENTS

| | | | | | |
|---|---|---|---|---|---|
| 5,713,613 | A * | 2/1998 | Honma et al. | ..... | 292/201 |
| 5,746,076 | A * | 5/1998 | Inoue | ..... | 70/277 |
| 6,059,328 | A * | 5/2000 | Gomi | ..... | 292/216 |
| 6,109,674 | A * | 8/2000 | Bartel et al. | ..... | 292/337 |
| 6,371,538 | B1 * | 4/2002 | Inoue | ..... | 292/216 |
| 7,703,310 | B2 * | 4/2010 | Usuzaki et al. | ..... | 70/237 |

(Continued)

FOREIGN PATENT DOCUMENTS

| | | | | |
|---|---|---|---|---|
| IT | EP 0894920 A1 * | 2/1999 | ..... | E05B 81/64 |
| IT | EP 0894924 A1 * | 2/1999 | ..... | E05B 81/06 |
| JP | 2012-12810 A | 1/2012 | | |

OTHER PUBLICATIONS

Computer Generated Translation for JP 2012-012810, http://search.proquest.com, translated on Jul. 9, 2015.*

*Primary Examiner* — Alyson M Merlino

(74) *Attorney, Agent, or Firm* — Skinner and Associates; Joel Skinner

(57) ABSTRACT

An operating device for a vehicle door latch comprises an inside handle, a base member fixed to a door, and inside lever connected to the inside handle, a locking lever, a housing, a motor, an output lever, a detected lever coupled to the inside handle and an inside-handle detecting switch. The motion of the inside handle is detected by the inside-handle detecting switch via the detected lever of the device to make the door open or close. Another detecting switch detects motion of a swinging member outside the housing.

2 Claims, 15 Drawing Sheets

(56) References Cited

U.S. PATENT DOCUMENTS

2004/0113437 A1* 6/2004 Hayakawa et al. ..... 292/201
2004/0262927 A1* 12/2004 Fukunaga et al. ..... 292/216
2005/0253400 A1* 11/2005 Harada et al. ..... 292/201
2005/0258652 A1* 11/2005 Usuzaki et al. ..... 292/216
2008/0012355 A1* 1/2008 Fujimatsu et al. ..... 292/216
2011/0154740 A1* 6/2011 Matsumoto et al. ..... 49/359
2012/0056437 A1* 3/2012 Takayanagi et al. ..... 292/118

* cited by examiner

OPERATING DEVICE FOR A VEHICLE DOOR LATCH

BACKGROUND OF THE INVENTION

The present invention relates to an operating device for a vehicle door latch.

In JP2012-12810A, an operating device for a vehicle door latch comprises, an outside lever connected to an outside handle on the door outside a vehicle, an inside lever connected to an inside handle on the door inside the vehicle, a locking lever for changing a door latch in a locking state and an unlocking state and an electric actuator for moving the locking lever to a locking position and an unlocking position on a base plate fixed in a door, In the device, an inside handle detecting switch is exposed on the base plate and is not suitable in view of water resistance. Electric wires connected to the inside-handle detecting switch are too long and increase the costs.

SUMMARY OF THE INVENTION

In view of the disadvantages in the prior art, it is an object of the present invention to provide an operating device for a vehicle door latch improving water resistance and reducing manufacturing costs.

It is another object of the present invention to provide an actuator for the operating device for a vehicle door latch, improving water resistance of a detecting switch for detecting swinging of the levers.

DETAILED DESCRIPTION OF PREFERRED EMBODIMENT

An embodiment of the present invention will be described with respect to the drawings. In the following description, the left and right sides are deemed as "front" and "rear" of a vehicle respectively in FIGS. 6-9 and FIGS. 11-15, and the front and back of the drawings are deemed as "inside of the vehicle" and "outside of the vehicle" respectively.

Figure 1:
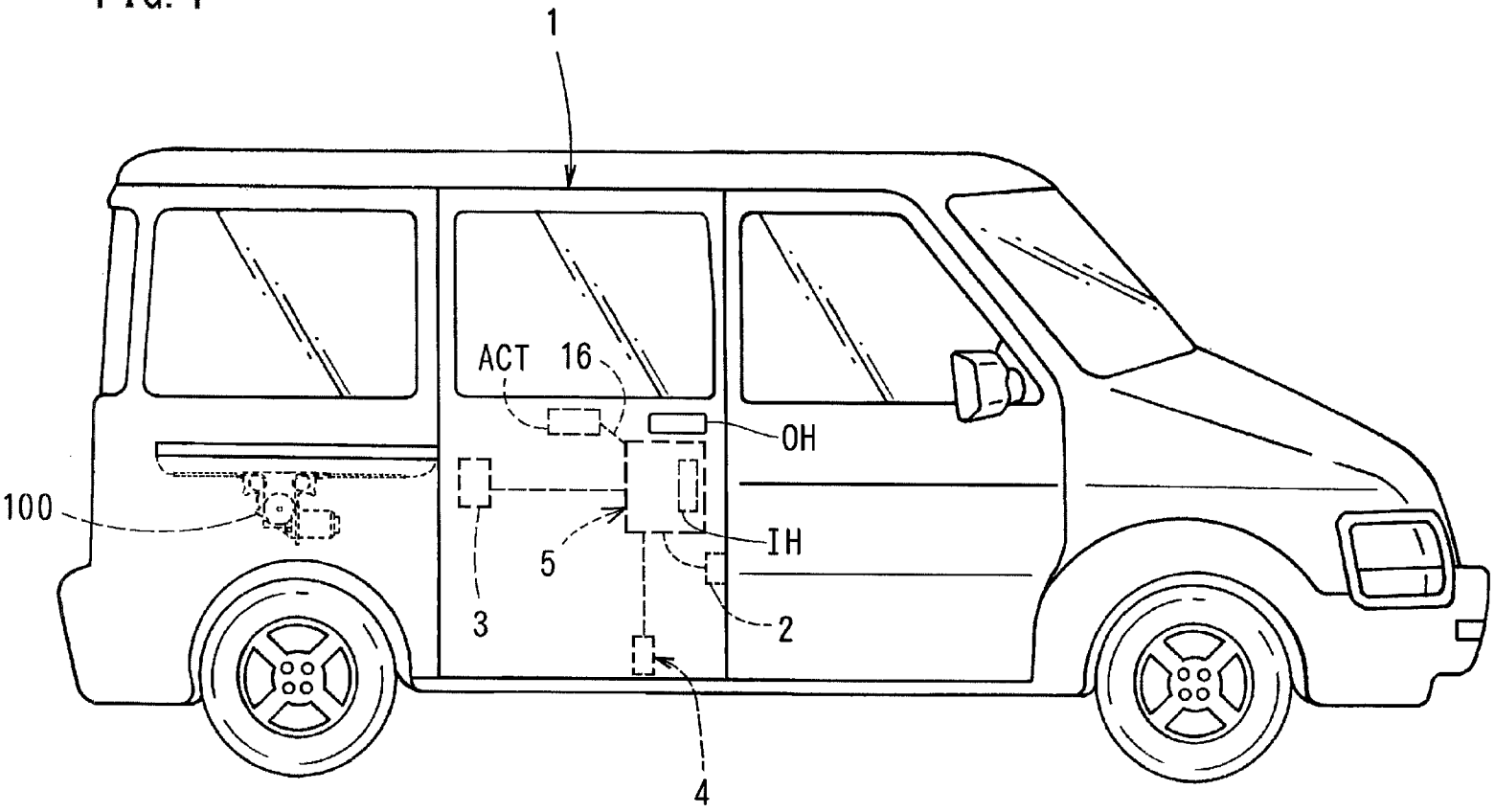
FIG. 1 is a side view of a vehicle in which the present invention is employed.

In FIG. 1, numeral 1 denotes a sliding door which opens and closes longitudinally at the side of a vehicle body; 2 denotes a fully-closed front-door latch unit in the door; 3 denotes a fully-closed rear-door latch unit in the door 1; 4 denotes a fully-open door latch unit attached to the door; and 100 denotes an electric opening unit for opening and closing the door 1.

On the outer panel of the door 1, an outside handle unit OH for opening and closing the door is provided, and on the inner panel of the door 1, an inside handle unit IH for opening and closing the door is provided. In the door 1, a motion-connecting section 5 controls operation by the outside handle unit OH and inside handle unit IH.

The fully-closing door latch units 2,3 engage with front and rear strikers (not shown) of a vehicle body respectively when the door 1 is fully closed. The fully-open door latch unit 4 engages with a striker (not shown) of the vehicle body when the door 1 is fully open.

Figure 2:
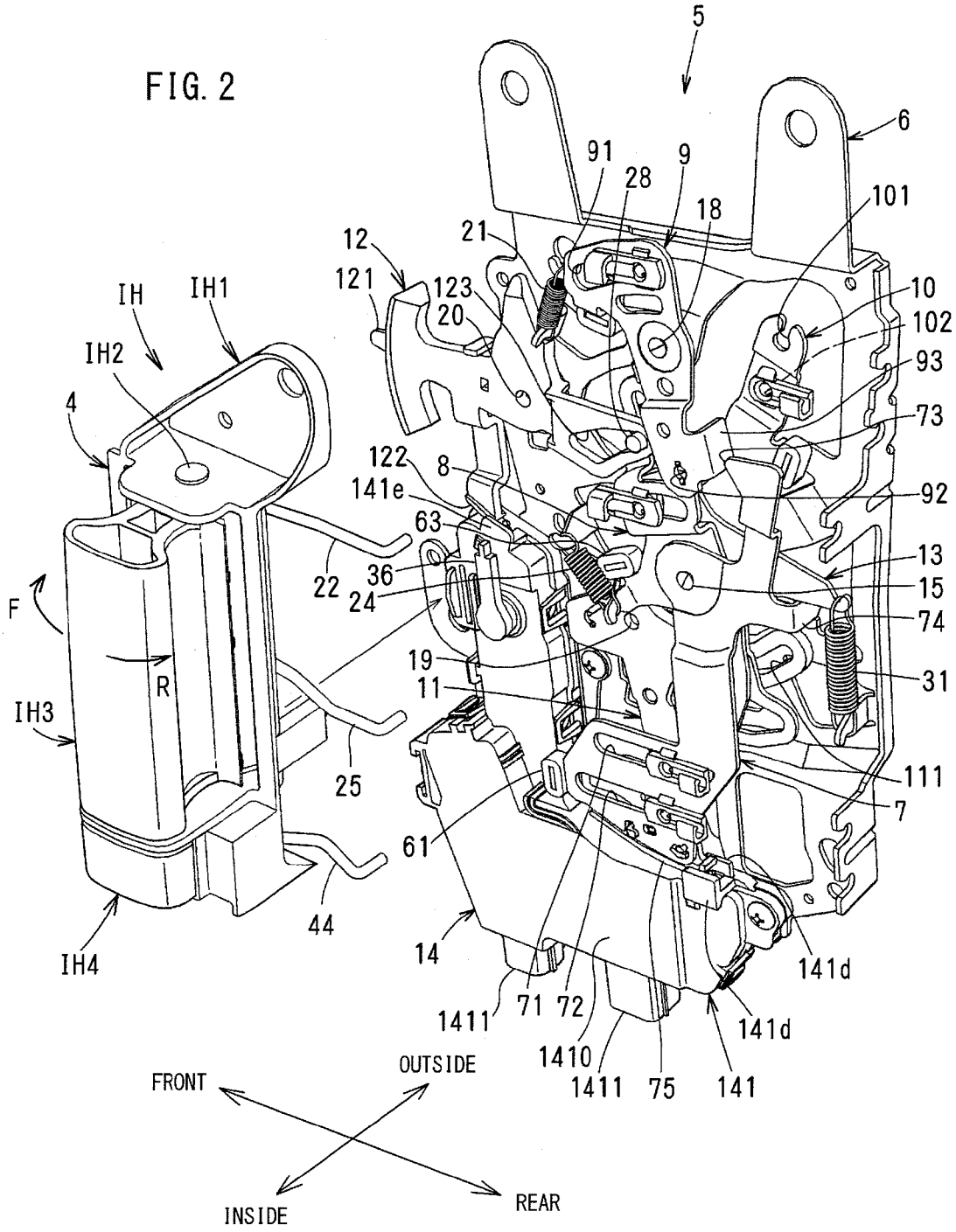
FIG. 2 is perspective view of a motion-connecting section and an inside handle unit in the present invention seen from the inside of a vehicle.
Figure 5:
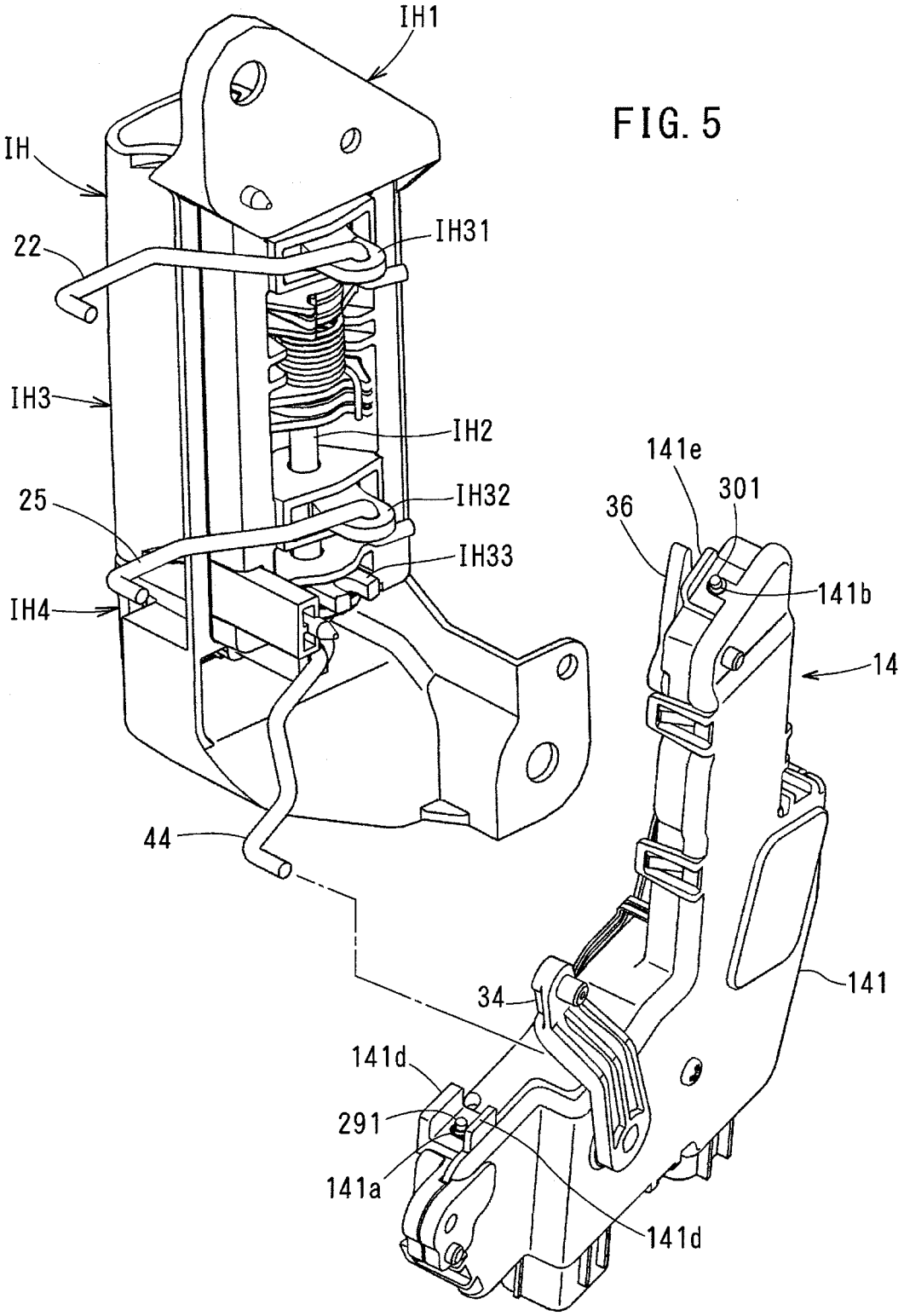
FIG. 5 is a perspective view of an inside handle unit and an actuator.

In FIGS. 2 and 5, the inside handle unit IH comprises a base IH1 fixed to the inner panel of the door 1; an inside handle IH3 pivoted to the base IH1 via a vertical pivot shaft IH2; and a knob handle IH4 for locking and unlocking the door 1.

Figure 3:
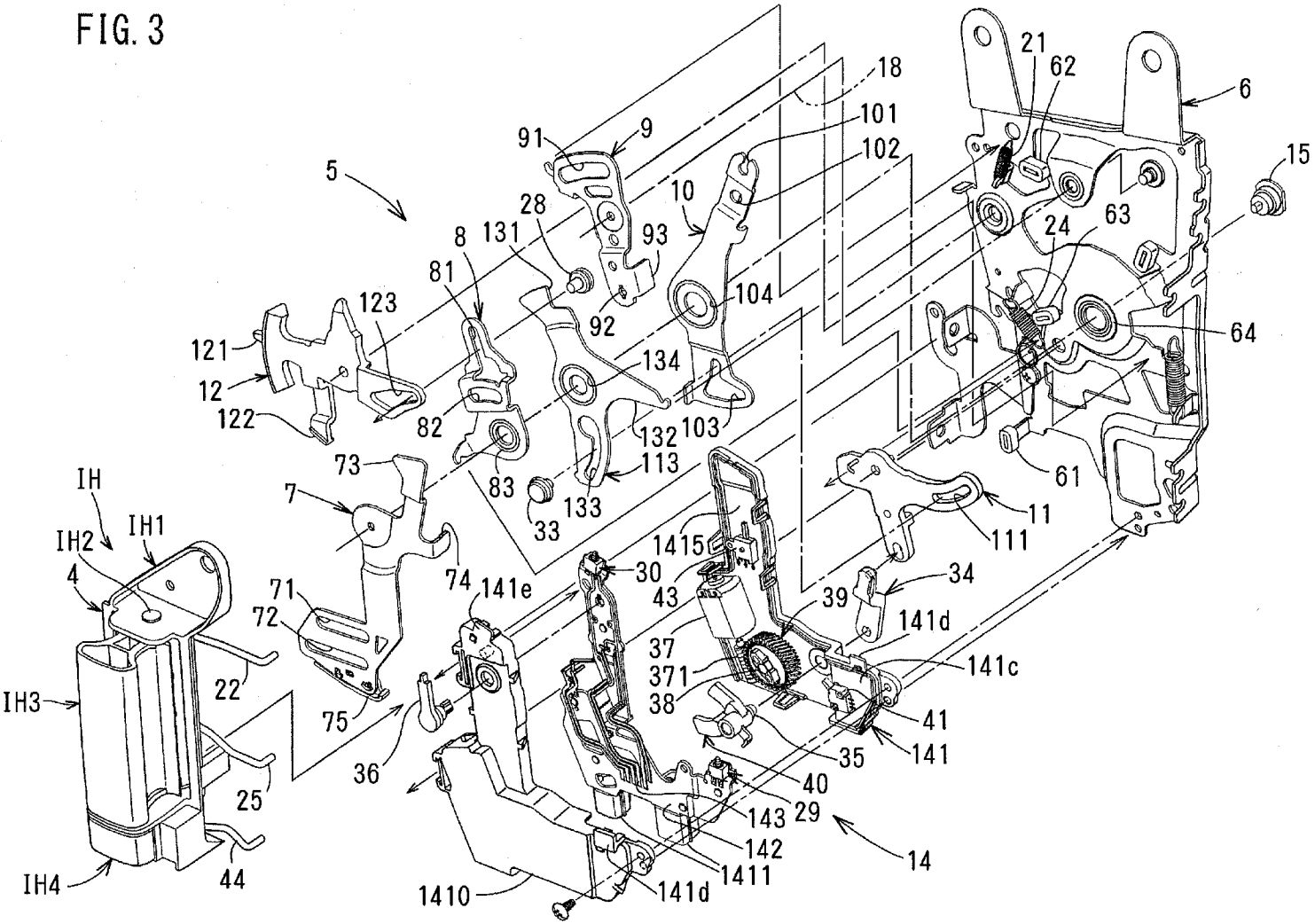
FIG. 3 is an exploded perspective view of the motion-connecting section seen from the inside of the vehicle.

The inside handle IH3 is usually held in a neutral position. In order to open the door 1, door-opening action or rearward turning is possible from the neutral position as shown by an arrow R in FIGS. 2 and 3, and in order to close the door 1, door-closing action or forward turning is possible from the neutral position as shown by an arrow F in FIGS. 2 and 3.

In FIG. 5, the inside handle IH3 comprises upper and lower connecting arms IH31,IH32 projecting toward the outside of the vehicle. Under the connecting arm IH32 is formed a U-shaped connecting portion IH33 which projects toward the outside of the vehicle or motion-connecting section 5. To the upper connecting arm IH31 is coupled the front end of a motion-transmitting member 22 via which door-closing action of the inside handle IH3 can be transmitted to the motion-connecting section 5. To the lower connecting arm IH32 is coupled a motion-transmitting member 25 via which door-opening action of the inside handle IH3 can be transmitted to the motion-connecting section 5. A detected lever 36 (later described) of the motion-connecting section 5 is held in the connecting portion IH33 when the inside handle unit IH and motion connection section 5 are attached to the door 1. To the knob handle IH4 is coupled a motion-transmitting member 44 for transmitting unlocking/locking action of the knob handle IH4 to the motion-connecting section 5.

In FIGS. 2, 3 and 6-8, the motion-connecting section 5 comprises a base plate 6 as base member fixed in the door 1. The base plate 6 comprises an outside lever 7 connected to the outside handle OH and an electric release actuator ACT in the door 1: an inside lever 8 connected to the inside handle IH3; a crank lever 9 connected to the inside handle IH3 and fully-open door latch unit 4; a release lever 10 connected to the fully-closing door latch units 2 and 3; a locking lever 11; a childproof lever 12; a connect lever 13; and an electric actuator 14 for locking/unlocking action.

Figure 6:
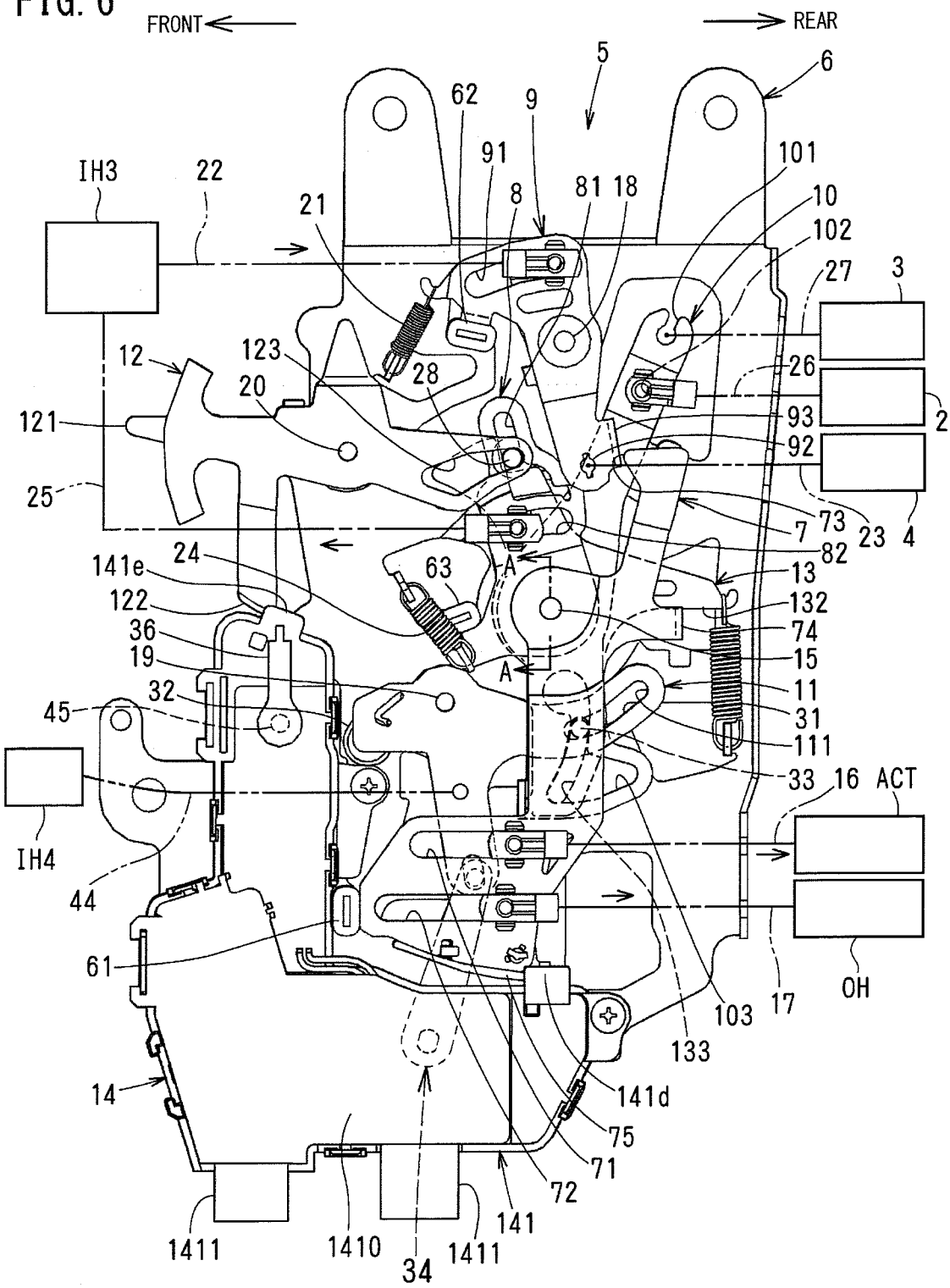
FIG. 6 is a front view of the motion-connecting section seen from the inside of the vehicle.
Figure 7:
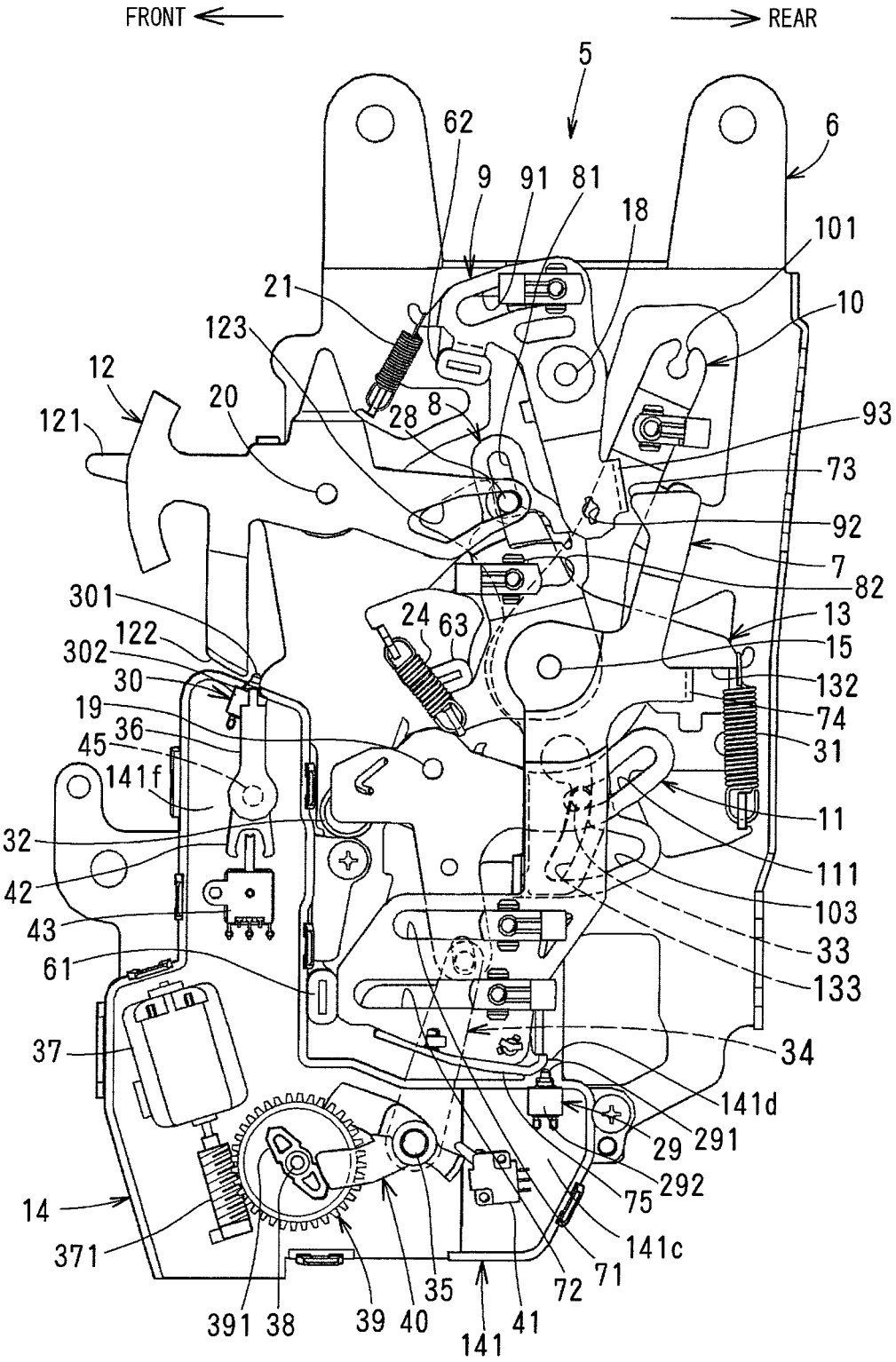
FIG. 7 is a front view of the motion-connecting section and actuator from which a cover is removed, seen from the inside of the vehicle.
Figure 8:
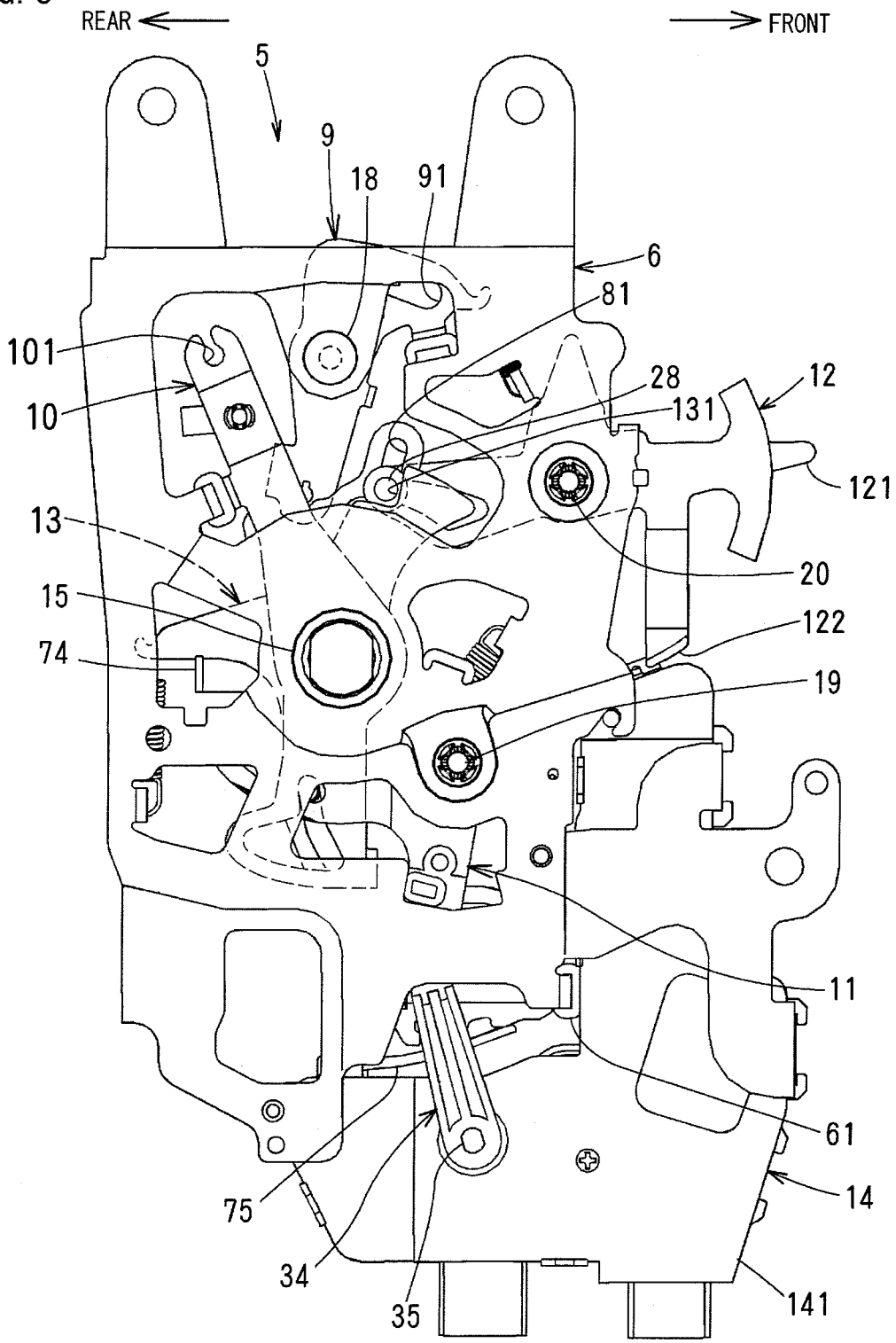
FIG. 8 is a back view of the motion-connecting section seen from the outside of the vehicle.

The outside lever 7 is pivoted via a shaft 15 extending transversely of the vehicle in the middle of the base plate 6 facing outside of the vehicle and is held in a neutral position in FIGS. 6 and 7 where the lower end is in contact with a stopper portion 61 of the base plate 6 in a standby state in which the outside handle OH and release actuator ACT do not work.

A slit 71 is formed in the lower part of the outside lever 7. To the slit 71 is coupled a motion-transmitting member 16 for transmitting to the outside lever 7 power of the release actuator ACT operable according to a switch (not shown) in the driver's seat and a portable remote control switch. The end of the motion-transmitting member 16 slides in the slit 71. Hence, the release actuator ACT works to allow the motion-transmitting member 16 to move as shown by an arrow in FIG. 6, and the outside lever 7 swings by a certain angle counterclockwise in FIG. 6 or in a releasing direction from the neutral position.

A slit 72 is formed under the slit 71 in the lower part of the outside lever 7. In the slit 72 is slidably connected one end of a motion-transmitting member 17 the other end of which is coupled to the outside handle OH. Hence, when the outside handle OH is operated to open the door, the motion-transmitting member 17 moves as shown by an arrow in FIG. 6. By manual operation of the outside handle OH, the outside lever 7 swings by a certain angle in a releasing direction from the neutral position similarly to the motion by the actuator ACT.

At the top of the outside lever is provided a pushing portion 73 with which the releasing action of the outside lever 7 can be transmitted to the crank lever 9. On the rear part of the outside lever 7 is provided a pushing portion 74 with which the releasing action of the outside lever 7 can be transmitted to the connect lever 13.

At the bottom of the outside lever 7 is disposed a detected portion 75 which can come in contact with a sensor 291 of a first detecting switch 29 for detecting the releasing action of the outside lever 7.

The crank lever 9 pivots on a pivot shaft 18 extending transversely of the vehicle above the shaft 15 on a surface of the base plate 6 facing the inside of the vehicle. The crank lever 9 is forced by one end of which is mounted to the crank lever 9 and the other end of which is mounted to the base plate 6 counterclockwise in FIG. 6 or toward the neutral position and is held in the neutral position in FIGS. 6,7 where the crank lever 9 is in contact with a stopper portion 62 of the base plate 6 in a neutral state where the crank lever 9 does not work.

A slit 91 is formed in the upper part of the crank lever 9, and a connecting hole 92 is formed in the lower part thereof. To the slit 91 is slidably the rear end of the motion-transmitting member 22 via which door-closing action of the inside handle IH3 is transmitted to the crank lever 9. To the connecting hole 92 is coupled the front end of the motion-transmitting member 23 the rear end of which is coupled to a release lever (not shown) of the fully-open door latch unit 4. When the door 1 is in a fully-open position by engaging the fully-open door latch unit 4 with the striker, the inside handle IH3 is operated to close the door 1, and the motion-transmitting member 22 moves rearward as shown by an arrow in FIG. 6. Hence, the crank lever 9 swings against the spring 21 from the neutral position in a releasing direction or clockwise in FIG. 6. The releasing action for swinging the crank lever 9 in the releasing direction is transmitted via the motion-transmitting member 23 to the fully-open door latch unit 4 which releases the latch from the striker to enable the door 1 to move for closing from the fully-open position.

On the lower part of the crank lever 9 is provided a pushed portion 93 which comes in contact with the pushing portion 73 of the outside lever 7. By the releasing action of the outside lever 7, the pushing portion 73 of the outside lever 7 comes in contact with the pushed portion 93, so that the crank lever 9 swings from the neutral position in the releasing direction similarly to the door-closing action of the inside handle IH3, and the fully-open door latch unit 4 is released.

The inside lever 8 pivots on the shaft 15 which is the same axis as that of the outside lever 7 to the base plate 6. The inside lever 8 is forced clockwise in FIG. 6 by a spring 24 which engages at one end with the inside lever 8 and at the other end with the base plate 6. The inside lever 8 is held in a neutral position in FIGS. 6 and 7 where it is in contact with a stopper portion 63 of the base plate 6 in a neutral state where the inside lever 8 does not work.

A slit 82 is formed in the upper part of the inside lever 8. The slit 82 is coupled to the end of the motion-transmitting member 25 via which door-opening action of the inside handle IH3 can be transmitted. The inside handle IH3 is operated to open the door 1, and the motion-transmitting member 25 moves forward in a direction by an arrow in FIG. 6. The inside lever 8 swings against the spring 24 from the neutral position counterclockwise in FIGS. 6 and 7 or in the releasing direction.

Furthermore, a control hole 81 is formed in the upper part of the inside lever 8. In the control hole 81 slides a control pin 28 which moves vertically based on motion of the childproof lever 12 to an unlocking or locking position (later described).

The childproof lever 12 pivots on a pivot shaft 20 to the base plate 6. The childproof lever 12 moves manually and is elastically held in the unlocking position in FIGS. 6 and 7 and in the locking position in FIGS. 14 and 15 to which the childproof lever 12 swings from the unlocking position.

In the front of the childproof lever 12 is provided a projection 121 which is operated manually only when the door 1 is open. In the lower end of the childproof lever 12 is provided a contacted portion 122 which can contact a sensor 301 in FIG. 7 of a second detecting switch 30 which can detect movement of the childproof lever 12 disposed in a housing 141 of the actuator 14. In the rear part of the childproof lever 12 is formed an elongate opening 123 in which the control pin 28 slides.

The control pin 28 can move vertically in the control hole 81 of the inside lever 8 according to unlocking/locking action of the childproof lever 12 and can move forward according to releasing action of the inside lever 8. When the childproof lever 12 is in the unlocking position, the control pin 28 is positioned in the lower part of the control hole 81 and is in the unlocking position where the releasing action of the inside lever 8 can be transmitted to the connect lever 13. When the childproof lever 12 is in the locking position, the control pin 28 is positioned in the upper part of the control hole 81 and is in the locking position in FIGS. 14 and 15 wherein the releasing action of the inside lever 8 cannot be transmitted to the connect lever 13.

The connect lever 13 pivots on the shaft 15 on which the outside lever 7 and inside lever 8 pivot to the base plate 6 and is forced clockwise in FIGS. 6 and 7 by a spring 31 which engages at one end with the connect lever 13 and at the other end with the base plate 6. The connect lever 13 is held in a neutral position in FIGS. 6 and 7 when the connect lever 13 does not work.

At the top of the connect lever 13 is provided a contacted portion 131 with which the control pin 28 can come in contact when the childproof lever 12 is in the unlocking position and with which the control pin cannot contact when the childproof lever 12 is in the locking position. Hence, when the childproof lever 12 and control pin 28 is in the unlocking position, the releasing action of the inside lever 8 is transmitted to the connect lever 13 via the control pin 28 and contacted portion 131 thereby allowing the connect lever 13 to swing from the neutral position against the spring 31 in the releasing direction. When the childproof lever 12 and control pin 28 are in the locking position, the control pin 131 cannot come in contact with the contacted portion 131, so that the releasing action of the inside lever 8 is not transmitted to the connect lever 13.

At the back of the connect lever 13 is provided a pushed portion 132 with which the pushing portion 73 of the outside lever 7 comes in contact upward. Hence, when the outside lever 7 moves for releasing, the pushing portion 74 of the outside lever 7 comes in contact with the pushed portion 132 of the connect lever 13 upward, so that the connect lever 13 moves for releasing against the spring 31 regardless of the position of the childproof lever 12.

In the lower part of the connect lever 13 is formed a vertical slit 133 in which a control pin 33 connected to the locking lever 11 slides vertically.

The locking lever 11 pivots on a pivot shaft 19 positioned below the shaft 15 to the base plate 6 and is elastically held by a turnover spring 32 which engages at one end with the locking lever 11 and at the other end with the base plate 6 in an unlocking position in FIGS. 6 and 7 and in a locking position which turns from the unlocking position clockwise in FIG. 13.

A motion-transmitting member 44 operated by a knob handle IH4 is coupled to the lower part of the locking lever 11. Thus, the locking lever 11 moves to the locking position with unlocking action of the knob handle IH4 and to the unlocking position with locking action thereof.

The lower end of the locking lever 11 is coupled to an output lever 34 (later described) of the actuator 14. The locking lever 11 moves to the unlocking and locking positions by the output lever 34.

At the rear of the locking lever 11 is formed a slit 111 in which the control pin 33 slides longitudinally of the vehicle.

To the base plate 6, the release lever 10 pivots on the shaft 15 on which the outside lever 7, inside lever 8 and connect lever 13 pivot, and is held in the neutral position in FIGS. 6 and 7 when the release lever 10 does not work in the neutral state.

To connecting holes 101,102 formed on the upper part of the release lever 10, one end of a motion-transmitting member 26 the other end of which is coupled to a cancelling lever (not shown) of the fully-closing front door latch unit 2 and one end of a motion-transmitting member 27 the other end of which is coupled to a cancelling lever (not shown) of the fully-closing rear door latch unit 3 are coupled respectively. Hence, the release lever 10 is moved counterclockwise in FIGS. 6 and 7 or in a releasing direction. The releasing action is transmitted to the cancelling levers of the fully-closing door-latch units 2 via the motion-transmitting members 26,27 respectively, so that the door latch units 2,3 are released to enable the door to open from the fully-closed position.

An L-shaped control opening 103 in which the control pin 33 slides is formed in the lower part of the release lever 10.

The control pin 33 slides through the slit 133 of the connect lever 13, the control opening 103 of the release lever 10, and the slit 111 of the locking lever 11. Thus, when the locking lever 11 is in the unlocking position, the control pin 33 is in an unlocking position of an upper part 103*a* of the control opening 103 and when the locking lever 11 is in the locking position, the control pin 33 is in a locking position of a lower part 103*b* of the control opening 103.

When the connect lever 11 and control pin 33 are in the unlocking position, the releasing action of the connect lever 13 is transmitted to the release lever 10 via the control pin 33. According to the releasing action of the release lever 10, the fully-closing door latch units 2,3 can be released. When the locking lever 11 and control pin 33 is in the locking position, even if the releasing action is carried out by the connect lever 13, the control pin 33 merely moves rearward through the lower part 103*b* of the control opening 33, so that the releasing action of the connect lever 13 is not transmitted to the release lever 10. Thus, the fully-open door latch units 2,3 cannot be released.

In the following description, "unlocking state" of the motion-connecting section 5 means that the locking lever 11 and control pin 33 are in the unlocking position, and "locking state" means that the locking lever 11 and control pin 33 are in the locking position. The actuator 14 changes to the unlocking state or locking state depending on change in state of the motion-connecting unit 5.

Figure 4:
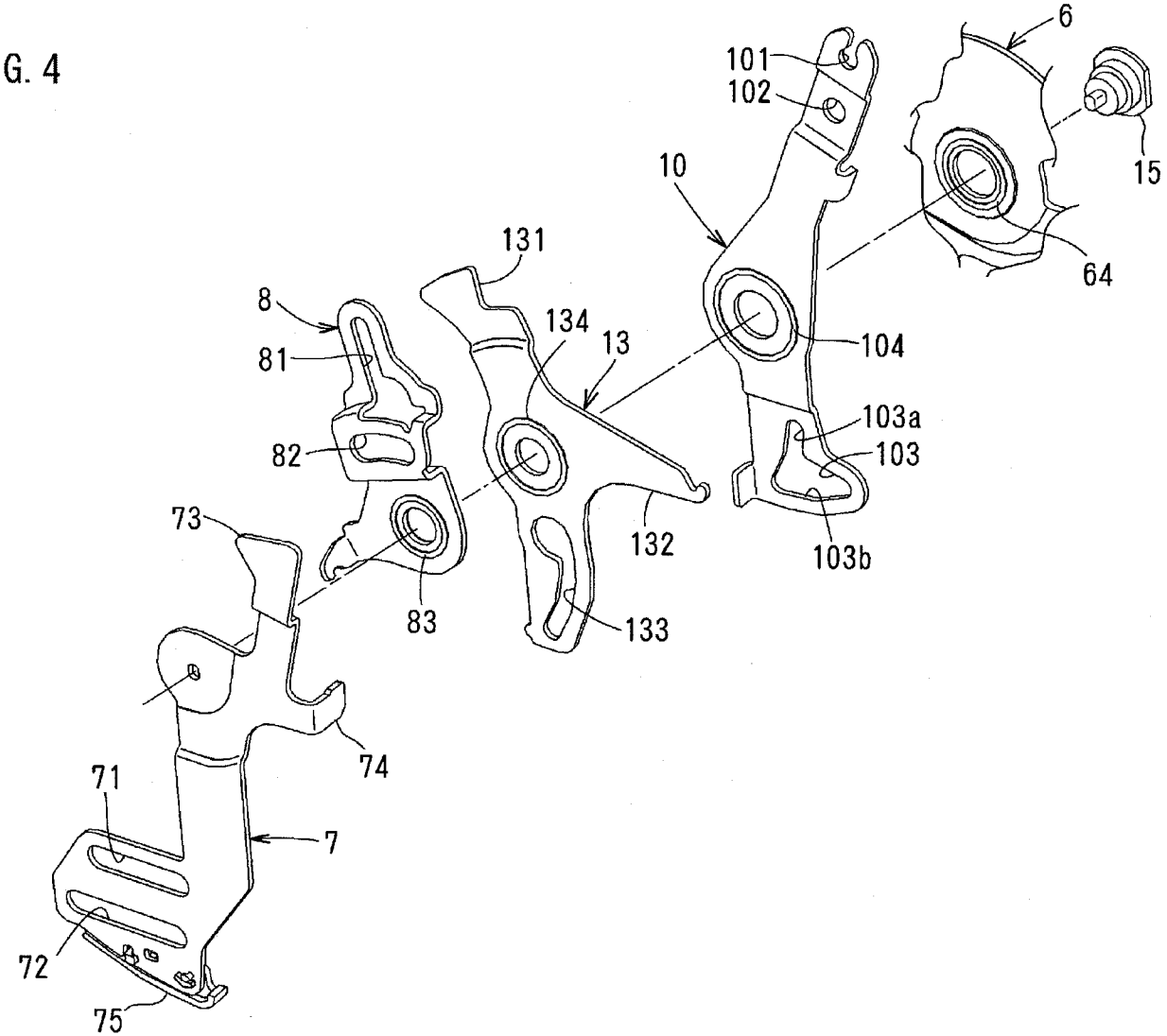
FIG. 4 is a perspective view of the motion-connecting section of the inside handle unit seen from the inside of the vehicle.
Figure 10:
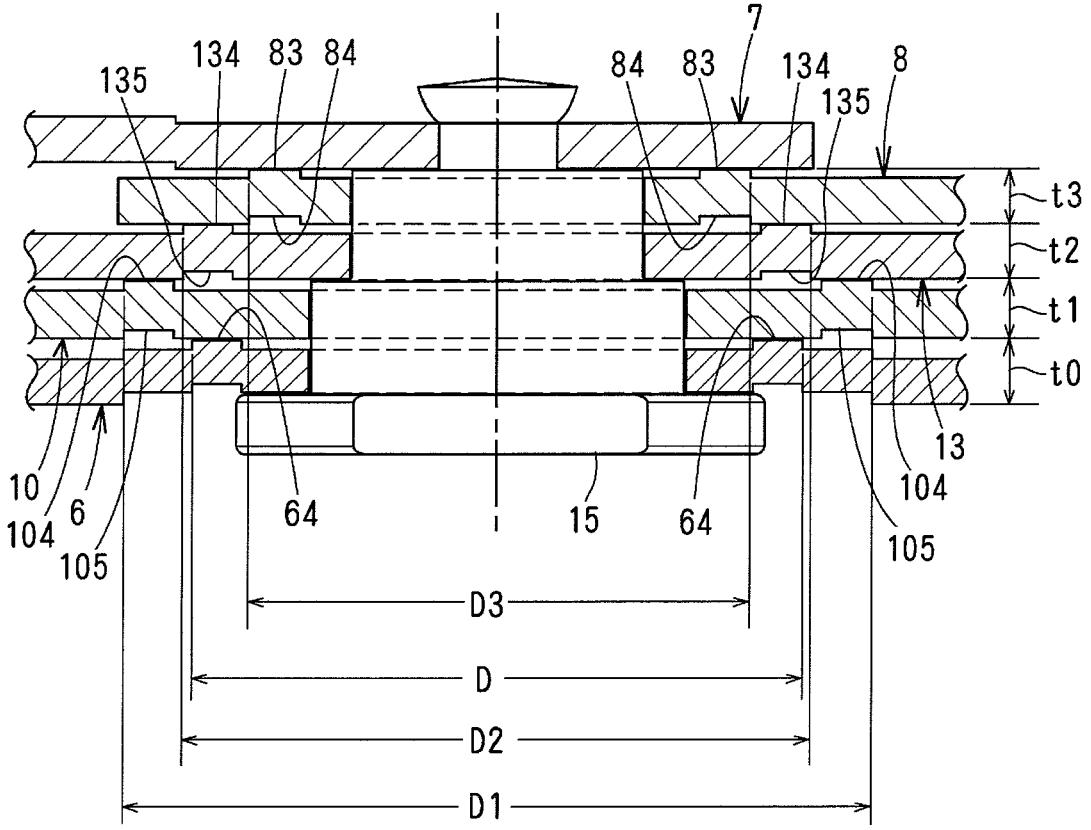
FIG. 10 is an enlarged sectional view taken along the line A-A in FIG. 6.

Then, with respect to FIGS. 4 and 10, the pivoting structure for pivoting the release lever 10, connect lever 13, inside lever 8 and outside lever 7 on the shaft 15 in order axially will be described.

To the base plate 6, the release lever 10, connect lever 13, inside lever 8 and outside lever 7 overlap in order axially so as to rotate independently.

On the surface of the base plate 6, an annular projection 64 having a diameter D around the shaft 15 is formed by embossing to project toward the rear surface of the release lever 10. Thus, without subjecting to effect in variation of thickness of the matrix of the base plate 6 made of sheet metal, it is possible to make the distance t0 between the rear surface of the base plate 6 and the top surface of the annular projection 64 as determined formerly.

On the surface of the release lever 10, an annular projection 104 having a diameter D1 larger than the diameter D around the shaft 15 is formed by embossing to project toward the rear surface of the connect lever 13. At the same time with the embossing, an annular recess 105 corresponding to the annular projection 104 is formed on the rear surface of the release lever 10.

Without subjecting to the effect in variation of thickness of matrix of the release lever 10 formed from sheet metal, it is possible to make the distance t1 between the rear surface of the release lever 10 and the top surface of the annular projection 104 as determined formerly. Since the diameter D of the annular projection 64 of the base plate 6 differs from the diameter D1 of the annular projection 104 of the release lever 10, the annular projection 64 of the base plate 6 does not fit in the annular recess 105 of the release lever 10 to enable the release lever 10 to rotate smoothly.

On the surface of the connect lever 13, an annular 134 projection having a diameter D2 smaller than the diameter D1 around the shaft 15 projects toward the rear surface of the inside lever 8 is formed embossing. At the same time with the embossing, an annular recess 135 corresponding to the annular projection 134 is formed on the rear surface of the connect lever 13.

Without subjecting to the effect of variation in thickness of the matrix of the connect lever 13 made of sheet metal, it is possible to make the distance t2 between the rear surface of the connect lever 13 and the top surface of the annular projection 134 as determined formerly. Since the diameter D1 of the annular projection 104 of the release lever 10 differs from the diameter D2 of the annular projection 134, the annular projection 104 of the release lever 10 does not fit in the annular recess 135 of the connect lever 13 to enable the release lever 10 to rotate smoothly with the connect lever 13.

On the surface of the inside lever 8, an annular projection 83 having a diameter D3 smaller than the diameter D2 around the shaft 15 is formed by embossing to project toward the rear surface of the outside lever 7. In the embossing, an annular recess 84 corresponding to the annular projection 83 is formed on the rear surface of the inside lever 8.

Without subjecting to the effect of variation in thickness of the matrix of the inside lever 8 made of sheet metal, it is possible to determine the distance t3 between the rear surface of the inside lever 8 and the top surface of the annular projection 83 as determined formerly. Since the diameter D2 of the annular projection 134 of the connect lever 13 differs from the diameter D3 of the annular projection 83 of the inside lever 8, the annular projection 134 of the connect lever 13 does not fit in the annular recess 84 of the inside lever 8 to enable the connecting lever 13 to rotate smoothly with the inside lever 8.

The annular projections 64,104,134,83 are formed by embossing on the surfaces of the base plate 6, release lever 10, connect lever 13 and inside lever 8. Even in the structure in which a plurality of levers 10,13,8,7 pivot on the same shaft to the base plate 6, it is possible to avoid the effect by variation in thickness of the matrix of the levers 10,13,8,7. It prevents the levers 10,13,8,7 from loosening axially with larger gaps between the levers and it prevents the levers 10,13,8,7 from turning heavily with no gaps between the levers, enabling the levers to turn smoothly. Furthermore, the surfaces of the levers do not contact one another to enable the levers to turn more smoothly. The axial distances of the levers 10,13,8,7 can be made as determined formerly to enable the number of steps formed on the shaft 15 to become smaller than the number of the levers, so that the manufacturing costs of the shaft 15 can be reduced.

The actuator 14 will be described.

In FIGS. 6-9, the actuator 14 has the L-shaped housing 141 fixed along the front lower portion of the rectangular base plate 6. The output lever 34 pivots on the pivot shaft 35 on the outer surface of the housing 141 facing the outside of the vehicle, and the detected lever 36 swings longitudinally of the vehicle around a pivot shaft 45. In order to show the inner structure of the housing 141 in FIG. 7, a cover 1410 for the housing 141 and a plate 142 fixed in the housing 141 are omitted.

The housing 141 includes the motor 37; a worm wheel 39 which pivots via a pivot shaft 38 below the motor 37; an active lever 40 which pivots via a pivot shaft 35 to turn with the output lever 34; the first detecting switch 29 for directly detecting the position of the outside lever 7; a second detecting switch 30 for directly detecting the position of the child-proof lever 12; an active-lever detecting switch 41 for directly detecting the position of an active lever 40; an inner detected lever 42 which turns with the detected lever 36; and an inside-handle detecting switch 43 for directly detecting the operation of the inside handle IH3 via the detected lever 36 and inner detected lever 42.

Figure 9:
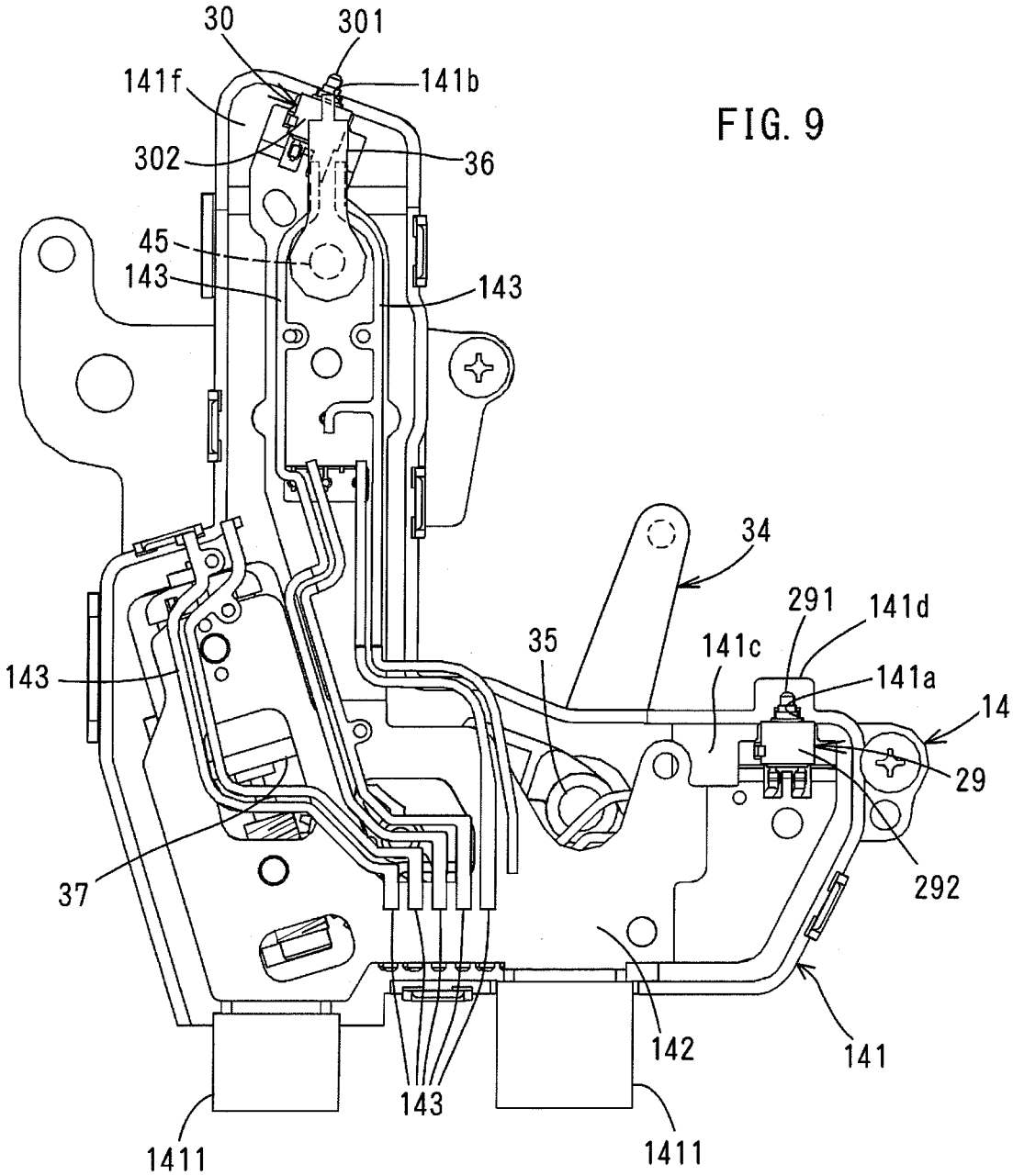
FIG. 9 is a front view of the actuator from which the cover is removed.

Furthermore, within the housing 141, a plate 142 is fixed to cover the inside of the housing 141 from the inside of the vehicle. In FIG. 9, the motor 37, the first and second detecting switches 29,30 and a number of conductive terminal plates 143 electrically connected to the switches 41,43 are provided on the surface of the plate 142 facing the inside of the vehicle. Hence, the motor 37, the first and second detecting switches 29,30 and detecting switches 41,43 are electrically connected to control circuits via wires (not shown) connected to a connector portion 1411 under the terminal plates 143 and plate 142.

The worm wheel 39 meshes with a worm 371 fixed to the shaft of the motor 37, rotates reversibly by the motor 37 and has engagement portions 391 projecting axially on the rotary surfaces. The engagement portions 391 provided on the rotary surface facing the outside of the vehicle are omitted.

Based on the rotation of the worm wheel 39 counterclockwise in FIG. 7 or in an unlocking direction with normal rotation of the motor 37, the active lever 40 comes in contact with the engagement portion 391 on the rotary surface facing the inside of the vehicle and swings to an unlocking position in FIG. 7. Based on the rotation of the worm wheel 39 clockwise in FIG. 7 or in a locking direction with reverse rotation of the motor 37, the active lever 40 comes in contact with the engagement portion 391 provided on the rotary surface facing the outside of the vehicle and turns to a locking position in FIG. 13 where it swings counterclockwise from the unlocking position.

The output lever 34 pivots with the active lever 40 and is coupled at the upper end to the lower end of the locking lever 11. Thus, with the rotation of the motor 37, the output lever 34 moves with the active lever 40 to the unlocking and locking positions, so that the locking lever 11 moves to the unlocking and locking positions.

When the motion-connecting section 5 and inside handle unit IH are connected in the door 1, the detected lever 36 pivots on the pivot shaft 45 on the surface facing the inside of the vehicle and the inside handle IH3 in the housing 141, and engages in the connecting portion IH33 of the inside handle IH3 in a direction of turning of the inside handle IH3. The detected lever 36 swings forward by door-opening action of the inside handle IH3 and swings rearward by door-closing action thereof.

The inner detected lever 42 turns forward or rearward with the detected lever 36 in the housing 141. The inner detected lever 36 is directly coupled to the inside handle IH3 with the detected lever 36, but is not connected indirectly to the inside handle IH3 via the motion-transmitting member such as a cable or a rod, enabling the inner detected lever 42 to move with the inside handle IH3 securely. The inside-handle detecting switch 43 detects the motion of the detected lever 36 via the inner detected lever 42 to enable the motion of the inside handle IH3 to be detected securely.

The inside-handle detecting switch 43 is attached in a vertical room 141*f* of the housing 141 and detects a swinging direction of the detected lever 36 and inner detected lever 42 thereby detecting a direction of action of the inside handle IH3 and transmitting a detected signal to control circuits. On the basis of the detected signal from the inside-handle detecting switch 43, the control circuits controls the electric opening unit 100 to move the door 1 to open when door-opening signal is inputted, and controls the electric opening unit 100 to move the door 1 to close when door-closing signal is inputted.

The first detecting switch 29 for detecting the outside lever 7 is fixed in a horizontal room 141*c* extending rearward of the housing 141 such that only the sensor 291 is exposed from the upper surface of the housing 141 or a small hole 141*a* which faces a detected portion 75 of the outside lever 7. The small hole 141*a* of the housing 141 is tightly covered with a switch body 292 of the first detecting switch 29 so as to prevent rain water from coming into the housing 141. At each side of the sensor 291 of the first detecting switch 29, guides 141*d*,141*d* for guiding the detected portion 75 of the outside lever 7 are provided.

With releasing action of the outside lever 7, the detected portion 75 of the outside lever 7 comes in contact with the sensor 291 of the first detecting switch 29 which detects that the outside lever 7 is on releasing action and a detected signal is transmitted to the control circuits. Based on the detected signal of the first detecting switch 29, the control circuits controls the electric opening unit 100 to open the door 1 if the door 1 is in the fully-closed position, and to close the door 1 if the door 1 is in the fully-open position. The detected portion 75 of the outside lever 7 is guided by the guides 141*d*,141*d* to ensure that it is in contact with the sensor 291 securely thereby enabling the first detecting switch 29 to detect the action of the outside lever 7 securely.

The second detecting switch 39 for detecting the childproof lever 12 is fixed in the vertical room 141*f* extending upward in the housing 141 such that only the sensor 301 is exposed from the top surface of the housing 141 or a small hole 141*b* facing the detected portion 122 of the childproof lever 12. The small hole 141*b* of the housing 141 is tightly covered with a switch body 302 of the second detecting switch 30 so as to prevent rain water from coming into the housing 141. At the side of the sensor 301 of the second detecting switch 30 in the housing 141, guides 141*e* for guiding the detected portion 122 of the childproof lever 12 are provided.

When the childproof lever 12 moves to the locking position to allow the detected portion 122 of the childproof lever 12 to come in contact with the sensor 301 of the second detecting switch 30, the second detecting switch 30 detects that the childproof lever 12 moves to the locking position in the childproof locking state, so that a detected signal is transmitted to the control circuits. The detected portion 122 of the childproof lever 12 is guided by the guides 141*e* to ensure that the detected portion 122 is in contact with the sensor 301 enabling the action of the childproof lever 12 to be detected securely.

As mentioned above, in the housing 141 of the actuator 14, the motor 37, detecting switches 29,30,41,43 and terminal plate 143 electrically connected to the switches 29,30,41,43 are disposed. Hence, it is not necessary to provide the detecting switches 41,30,29 for detecting the levers 11,12,13, the inside-handle detecting switch 43 for detecting the action of the inside handle IH3 or electric wires electrically connected to the detecting switches 29,30,41,43, improving water tightness on the detecting switches 29,30,41,43 and reducing the costs for electric wires electrically connected to the switches 29,30,41,43 outside the housing 141. It is also possible to connect wiring for the motor 37 with wiring for the switches 29,30,41,43 thereby reducing the costs. The housing 141 for the actuator 14 is shaped like "L" and fixed to the lower part of the rectangular base plate 6 in front of the base plate 6, and the detecting switches 29,30,41,43 are not disposed on the base plate 6, thereby improving flexibility in layout of the levers on the base plate 6.

The function of the embodiments will be described with respect to FIGS. 11-15.

The outside handle OH is operated to open the door when the door 1 is held in the fully-closed state, and when the motion-connecting section 5 and childproof lever 12 are in the unlocking state and unlocking position respectively.

When the door 1 is held in the fully-closed position, the fully-closing door latch units 2,3 engage with the strikers. When the motion-connecting unit 5 is in the unlocking state, the locking lever 11, control pin 33, output lever 34 and active lever 40 are in the unlocking position respectively.

Figure 11:
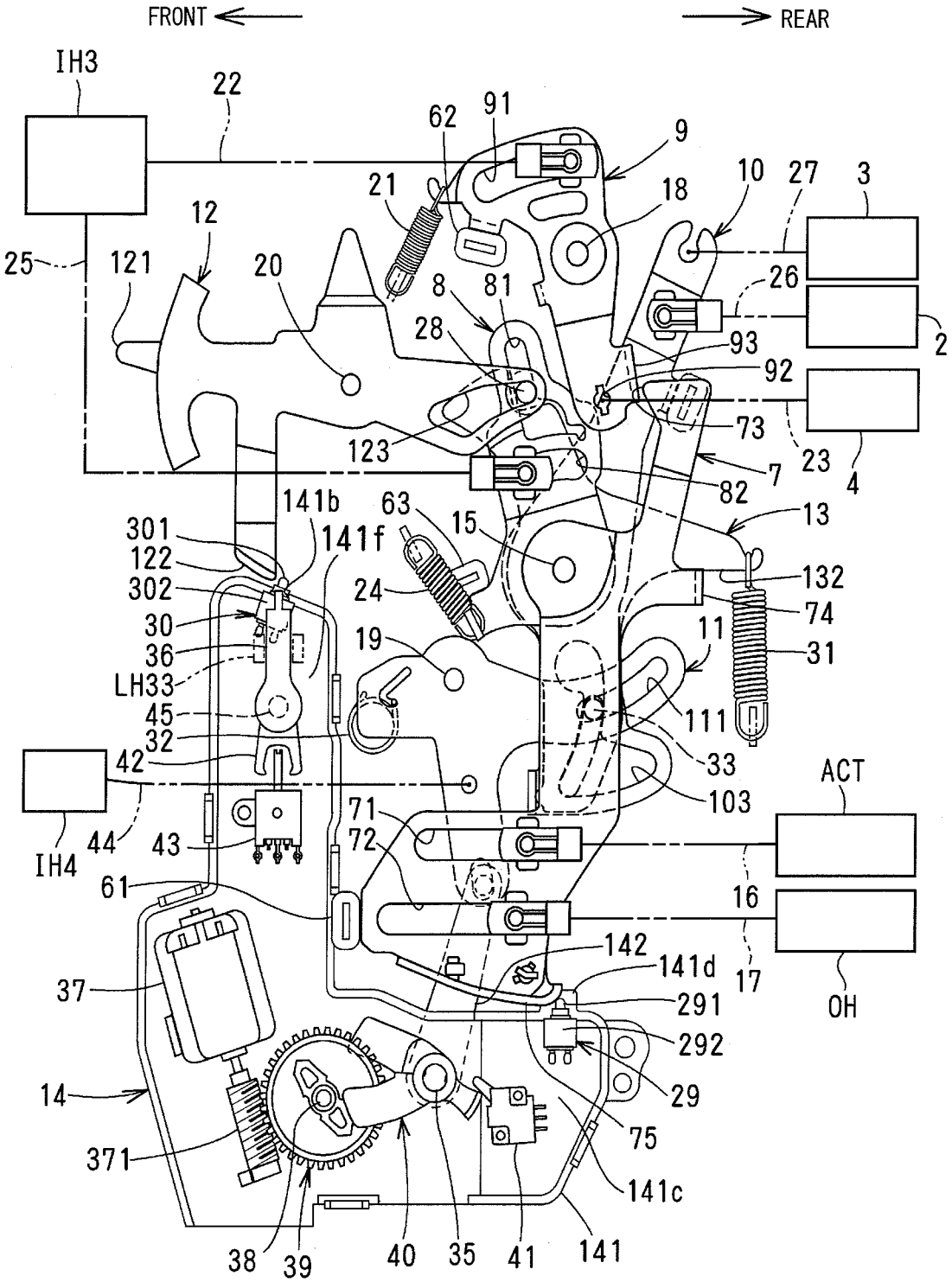
FIG. 11 is a front view of the motion-connecting section in an unlocking state.

In the unlocking state in FIG. 11, when the outside handle OH is operated, its motion is transmitted to the outside lever 7 via the motion-transmitting member 17. The outside lever 7 turns counterclockwise in FIG. 11 in a releasing direction from the neutral position. The pushing portion 74 of the outside lever 7 comes in contact with the pushed portion 132 of the connect lever 13 upward to allow the connect lever 13 to turn counterclockwise in FIG. 11 or in a releasing direction to turn against the spring 31. The control pin 33 is in the unlocking position for transmitting turning of the connect lever 13 to the release lever 10, so that the releasing action of the connect lever 13 is transmitted to the release lever 10 via the control pin 33 and the release lever 10 turns in the releasing direction.

Figure 12:
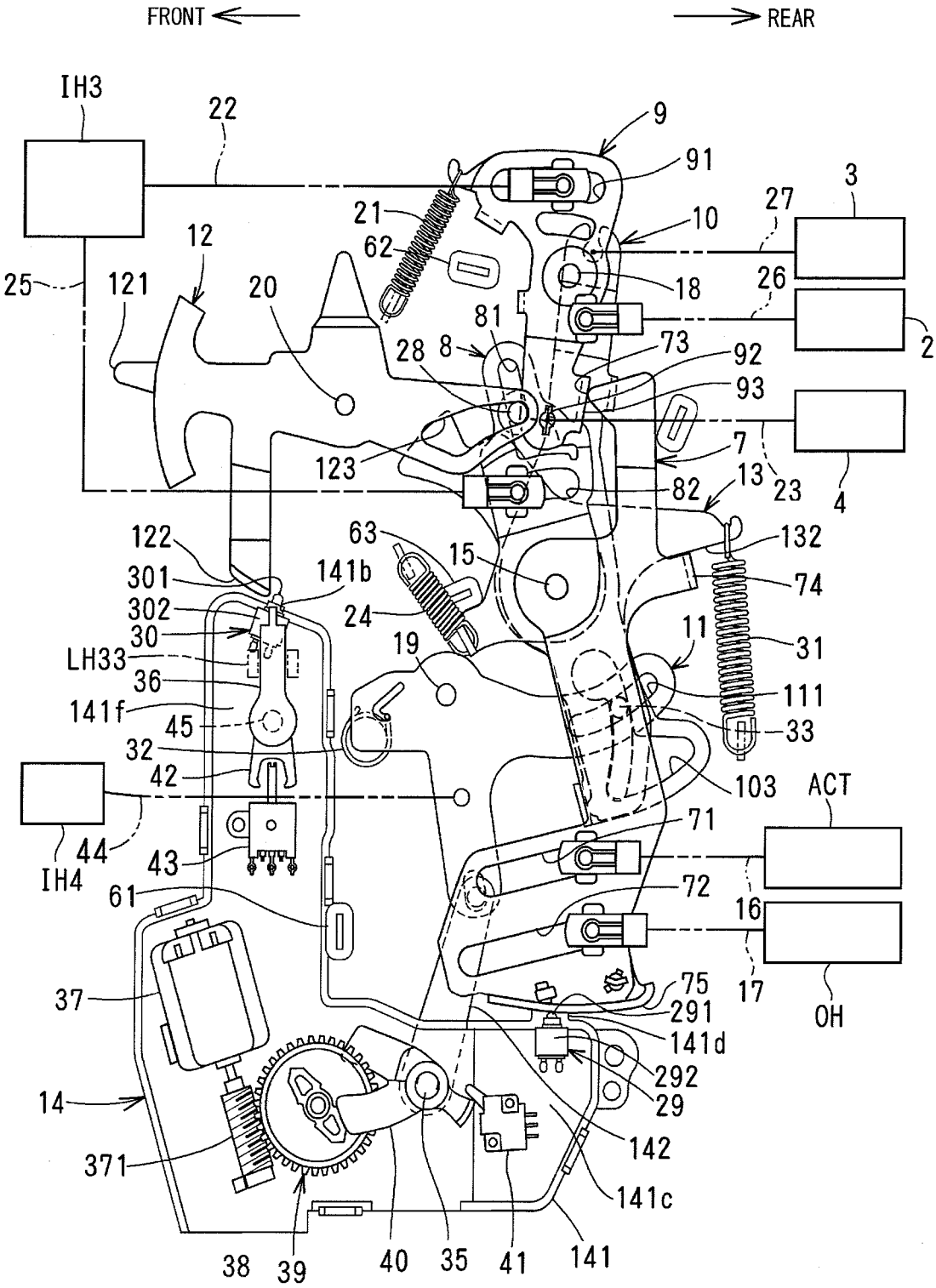
FIG. 12 is a front view of the motion-connecting section in which an outside lever is operated for releasing.

In FIG. 12, when the operating lever is operated for releasing, the detected portion 75 of the outside lever 7 moves rearward along the upper surface of the housing 141 of the actuator 14 and comes in contact with the sensor 291 of the first detecting switch 29. Hence, the first detecting switch 29 detects that the outside lever 7 is operated for releasing, and a detected signal is transmitted to the control circuits.

The releasing action of the release lever 10 is transmitted to the fully-closing door latch units 2,3 via the motion-transmitting members 26,27 to release the fully-closed door latch units 2,3. Right after latch releasing is completed, the control circuits controls the electric opening unit 100 based on detected signal of the first detecting switch 29. Thus, the door 1 slides open by the electric opening unit 100.

In the unlocking state in FIG. 11, when the switch for opening the door is operated to open the door, the release actuator ACT works. By the operation similar to the motion by the outside handle OH, the outside lever 7 is operated for releasing, and the fully-closed door latch units 2,3 are released, so that the door 1 can be opened.

The inside handle IH3 is operated to open the door when the door 1 is in the fully-open position and when the motion-connecting section 5 and childproof lever 12 are in the unlocking state and unlocking position respectively.

When the inside handle IH3 is operated to open the door in FIG. 11, the door-opening action of the inside handle IH3 is transmitted to the inside lever 8 via the motion-transmitting member 25. The inside lever 8 turns counterclockwise in FIG. 11 or in the releasing direction against the spring 24 from the neutral position, the releasing action of the inside lever 8 is transmitted to the connect lever 13 via the control pin 33. Similarly to the releasing action by the outside lever 7, the releasing action of the connect lever 13 is transmitted to the release lever 10, so that the door latch units 2,3 are released to enable the door 1 to slide open.

The actuator 14 is operated to lock the door when the door 1 is held in the fully-open position and when the motion-connecting section 5 and childproof lever 12 are in the unlocking state and unlocking position respectively.

When the motor 37 of the actuator 14 rotates in the locking direction in FIG. 11, the rotation is transmitted to the active lever 40 and output lever 34 via the worm 37 and worm wheel 39, and the action of the active lever 40 and output lever 34 from the unlocking position to the locking position is transmitted to the locking lever 11. Thus, in FIG. 13, the locking lever 11 moves from the unlocking position to the locking position against the spring 32, and the control pin 33 moves to the locking position, so that the motion-connecting section 5 changes from the unlocking state to the locking state.

The knob handle IH4 is operated to lock the door when the door 1 is held in the fully-closed state and when the motion-connecting section 5 and childproof lever 12 are in the unlocking state and unlocking position respectively.

When the knob handle IH4 is operated to lock the door in FIG. 11, the action is transmitted to the locking lever 11 via the motion-transmitting member 44, and the locking lever 11 moves from the unlocking position to the locking position against the turnover spring 32. Thus, in FIG. 13, with the movement of the locking lever 11 to the locking position, the output lever 34, active lever 40 and control pin 33 move to the locking position, and the motion-connecting section 5 changes from the unlocking state to the locking state.

The outside handle OH is operated when the door 1 is held in the fully-open position and when the motion-connecting section 5 and childproof lever 12 are in the locking state and unlocking state respectively.

When the motion-connecting section 5 is in the locking state, the locking lever 11, control pin 33, output lever 34 and active lever 40 are in the locking position.

Figure 13:
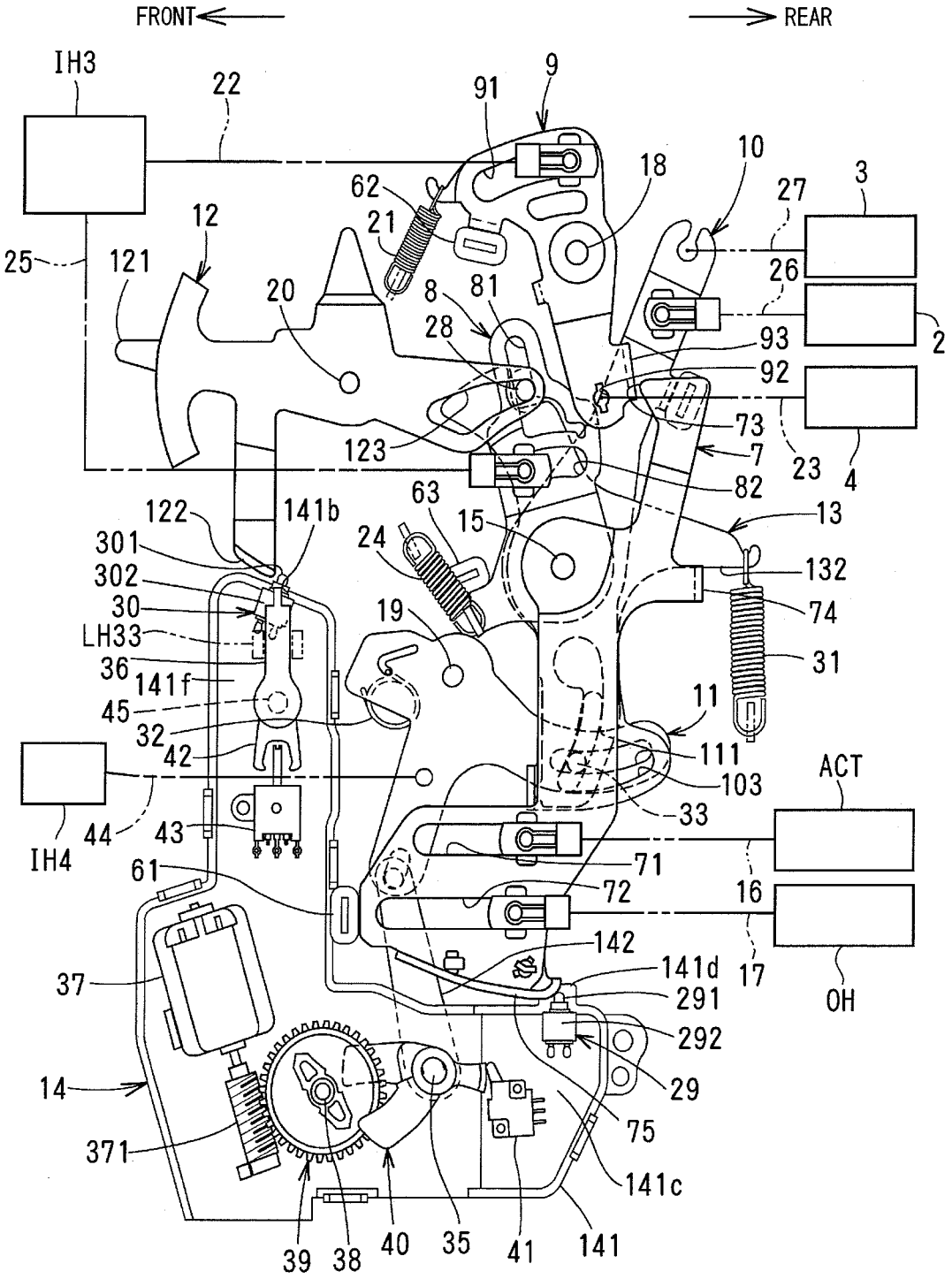
FIG. 13 is a front view of the motion-connecting section in a locking state.

The outside handle OH is operated in FIG. 13, and the action of the outside handle OH is transmitted to the outside lever 7 via the motion-transmitting member 17. The outside lever 7 turns counterclockwise in FIG. 13 in the releasing direction from the neutral position, and the pushing portion 74 comes in contact with the pushed portion 132 of the connect lever 13 upward to make the connect lever 13 turn counterclockwise in FIG. 13 or in the releasing direction against the spring 31. However, the control pin 33 is in the locking position where the rotation of the connect lever 13 cannot be transmitted to the release lever 10. Thus, the releasing action of the connect lever 13 is not transmitted to the release lever 10. Thus, the fully-closing door latch units 2,3 are not released to disable the door 1 to open.

The inside handle IH3 is operated for door-opening when the door 1 is held in the fully-closed position and when the motion-connecting section 5 and childproof lever 12 are in the locking state and unlocking position respectively.

When the inside handle IH3 is operated to open the door in FIG. 13, the door-opening action of the inside handle IH3 is transmitted to the inside lever 8 via the motion-transmitting member 25. The inside lever 8 turns against the spring 24 counterclockwise in FIG. 13 in the releasing direction from the neutral position, In this case, the control pin 28 is in the unlocking position where the releasing action of the inside lever 8 can be transmitted to the connect lever 13. Thus, the releasing action of the inside lever 8 is transmitted to the connect lever 13. However, the control pin 33 is in the locking position, the releasing action of the connect lever 13 is not transmitted to the release lever 10 similar to the releasing action of the outside lever 7. Hence, the fully-closing door latch units 2,3 cannot be released, so that the door 1 cannot be opened.

The actuator ACT is unlocked when the door 1 is held in the fully-closed position and when the motion-connecting section 5 and childproof lever 12 are in the locking state and unlocking position respectively.

When the motor 37 of the actuator ACT rotates in the unlocking direction in FIG. 13, the rotation is transmitted to the locking lever 11 via the worm 371, worm wheel 39, active lever 40 and output lever 34. Hence, the locking lever 11 moves from the locking position to the unlocking position against the turnover spring 32 in FIG. 11, and the control pin 33 moves to the unlocking position to make the motion-connecting section 5 change from the locking state to the unlocking state. The active lever detecting switch 41 detects that the active lever 40 moves to the unlocking position or that the locking lever 11 moves to the unlocking position, and transmits an unlock-detecting signal to the control circuits.

The knob handle IH4 is operated to unlock the door when the door 1 is held in the fully-closed position and when the motion-connecting section 5 and childproof lever 12 are in the locking state and in the unlocking position respectively.

The knob handle IH4 is operated to unlock the door in FIG. 13, and the unlocking action is transmitted to the locking lever 11 via the motion-transmitting member 44, and the locking lever 11 moves from the locking position to the unlocking position against the turnover spring 32. Hence, with the movement of the locking lever 11 to the unlocking position, the control pin 33, output lever 34 and active lever 40 move to the unlocking position, and the motion-connecting section 5 changes from the locking state to the unlocking state.

The outside handle OH is operated when the door 1 is held in the fully-closed position and when the motion-connecting section 5 and childproof lever 12 are in the unlocking state and in the locking position respectively.

Figure 14:
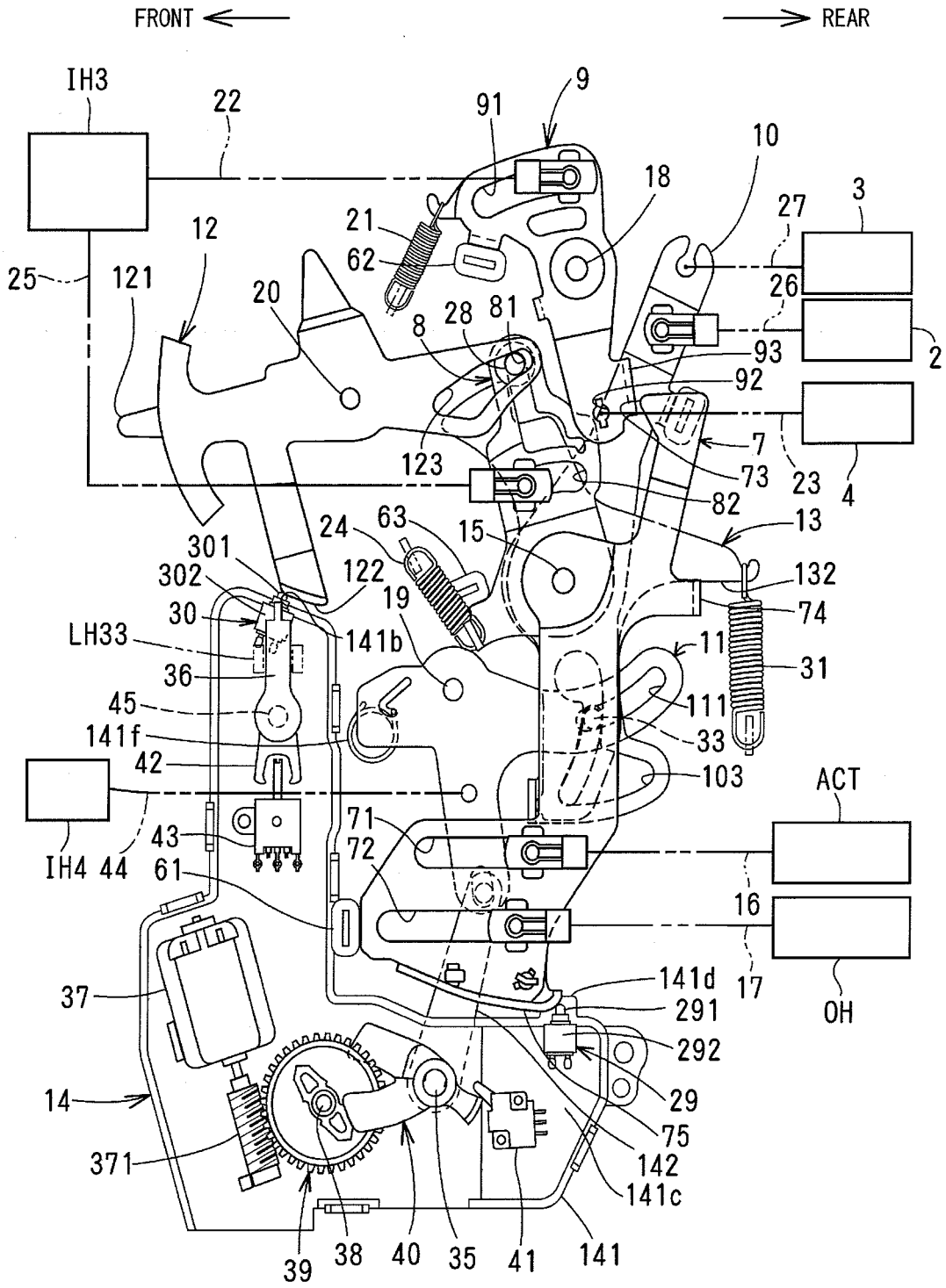
FIG. 14 is a front view of the motion-connecting section in which the motion-connecting section is in an unlocking state and the childproof lever is in a locking position.

When the outside handle OH is operated in FIG. 14, the action of the outside handle OH is transmitted to the outside lever 7 via the motion-transmitting member 17, and the outside lever 7 swings counterclockwise in FIG. 14 in the releasing direction from the neutral position. Hence, similarly to the childproof lever 12 in the unlocking position, the pushing portion 74 of the outside lever 7 comes in contact with the pushed portion 132 of the connect lever 13 upward and the connect lever 13 turns counterclockwise in FIG. 14 in the releasing direction against the spring 31. The releasing action of the connect lever 13 is transmitted to the release lever 10 via the control pin 33 to turn the release lever 10 in the releasing direction. Thus, the releasing action of the release lever 10 is transmitted via the motion-transmitting members 26,27 to the fully-closed door latch units 2,3 which are released, so that the door 1 can slide open.

The inside handle IH3 is operated to open the door when the door 1 is held in the fully-open position and when the motion-connecting section 5 and childproof lever 12 are in the unlocking state and locking position respectively.

When the childproof lever 12 is in the locking position in FIG. 14, the control pin 28 is in the locking position where the releasing action of the inside lever 8 cannot be transmitted to the connect lever 13. Thus, even if the inside handle IH3 is operated to open the door to release the inside lever 8, the releasing action is not transmitted to the connect lever 13. The door-opening action of the inside handle IH3 is not transmitted to the fully-closing door latch units 2,3, so that the door 1 cannot be opened.

The outside handle OH is operated when the door 1 is in the fully-open position and when the motion-connecting section 5 and childproof lever 12 are in the locking state and locking position respectively.

Figure 15:
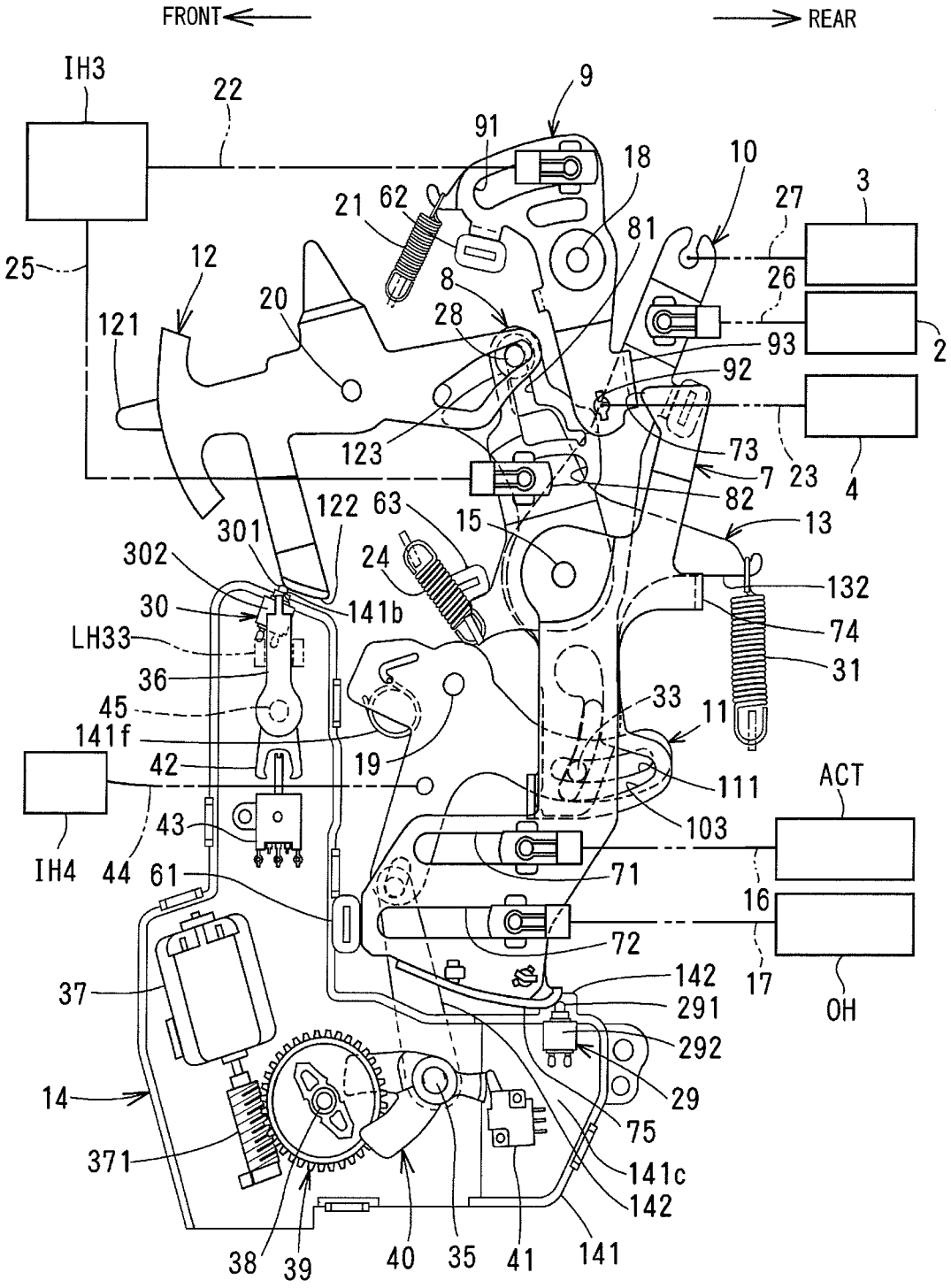
FIG. 15 is a front view of the motion-connecting section in which the motion-connecting section is in the locking state and the childproof lever is in the locking position.

When the outside handle OH is operated in FIG. 15, the action of the outside handle OH is transmitted via the motion-transmitting member 17 to the outside lever 7 which swings counterclockwise in FIG. 15 in the releasing direction from the neutral position. However, the control pin 33 is in the locking position where the releasing action of the connect lever 13 cannot be transmitted to the release lever 10, so that the releasing action of the outside lever 7 is not transmitted to the release lever 10. Thus, the fully-closing door latch units 2,3 are not released, so that the door 1 cannot be opened.

The inside handle IH3 is operated to open the door when the door 1 is held in the fully-closed position and when the motion-connecting section 5 and childproof lever 12 are in the locking state and locking position respectively.

When the inside handle IH3 is operated to open the door in FIG. 15, the inside lever 8 is released, but the control pin 28 is in the locking position. The releasing action of the inside lever 8 is not transmitted to the connect lever 13 and release lever 10. Thus, the door-opening action of the inside handle IH3 is not transmitted to the fully-closing door latch units 2,3, so that the door cannot be opened.

The outside handle OH is operated when the door 1 is held in the fully-open position and when the motion-connecting section 5 and childproof lever 12 are in the unlocking state and unlocking position respectively.

When the door 1 is held in the fully-open position, the fully-open door latch unit 4 engages with the striker.

When the outside handle OH is operated in the unlocking state in FIG. 11, the action of the outside handle OH is transmitted to the outside lever 7 via the motion-transmitting member 17 as well as the door 1 is closed, and the outside lever 7 swings from the neutral position in the releasing direction, so that the connect lever 13 and release lever 10 move for releasing. Simultaneously, the pushing portion 73 of the outside lever 7 comes in contact with the pushed portion 93 of the crank lever 9 forward thereby moving the crank lever 9 against the spring 21 from the neutral position in the releasing direction The motion of the crank lever 9 releases the fully-open door latch unit 4 via the motion-transmitting member 23 so as to slide the door 1 closed.

The inside handle IH3 is operated for door-closing when the door 1 is held in the fully-open position and when the motion-connecting section 5 and childproof lever 12 are in the unlocking state and unlocking position respectively.

When the inside handle IH3 is operated for door-closing in FIG. 11, the door-closing action of the inside handle IH3 is transmitted to the crank lever 9 via the motion-transmitting member 22. The crank lever 9 is moved in the releasing direction, and the fully-open door latch unit 4 is released via the motion-transmitting member 23 to enable the door 1 to close.

The outside handle OH is operated when the door 1 is held in the fully-open position and when the motion-connecting section 5 and childproof lever 12 are in the locking state and unlocking position respectively.

When the outside handle OH is operated in the locking state in FIG. 13, the action of the outside handle OH is transmitted to the outside lever 7 via the motion-transmitting member 17 as well as the door 1 is closed, so that the outside lever 7 is moved for releasing. The releasing action is not transmitted to the release lever 10, but the pushing portion 73 of the outside lever 7 comes in contact with the pushed portion 93 of the crank lever 9 forward. Hence, the crank lever 9 is moved in the releasing direction even in the locking state, and the fully-open door latch unit 4 is released to enable the door 1 to close.

The inside handle IH3 is operated for door-closing when the door 1 is held in the fully-open position and when the motion-connecting section 5 and childproof lever 12 are in the locking state and unlocking position respectively.

When the inside handle IH3 is operated for door-closing in FIG. 13, the door-closing action of the inside handle IH3 is transmitted to the crank lever 9 via the motion-transmitting member 22 and the crank lever 9 is moved for releasing. Hence, the releasing action of the crank lever 9 is transmitted to the fully-open door latch unit 4 via the motion-transmitting member 23 to enable the door 1 to close.

The childproof lever 12 is operated for locking when the door 1 is held in the fully-open position and when the motion-connection section 5 and childproof lever 12 are in the uncloking state and unlocking position respectively.

When the projection 121 of the childproof lever 12 exposed from the front end face of the door 1 is manually pushed down in FIG. 11, the childproof lever 12 turns counterclockwise in FIG. 11 or in a locking direction from the unlocking position to the locking position in FIG. 14. The control pin 28 moves with the childproof lever 12 to the locking position.

When the childproof lever 12 and control pin 28 move to the locking position, the detected portion 122 of the childproof lever 12 moves rearward along the upper surface of the housing 141 of the actuator 14 and comes in contact with the sensor 301 of the second detecting switch 30. Hence, the second detecting switch 30 detects that the childproof lever 12 moves to the locking position, and a locking-detected signal is transmitted to the control circuits.

The outside handle OH is operated when the door 1 is held in the fully-open position and when the motion-connecting unit 5 and childproof lever 12 are in the unlocking state and locking position respectively.

When the outside handle OH is operated in FIG. 14, the action of the outside handle OH is transmitted to the outside lever 7 via the motion-transmitting member 17. The releasing action of the outside lever 7 is transmitted to the crank lever 9 via the pushing portion 73 and pushed portion 93, and the releasing action of the crank lever 9 is transmitted to the fully-open door latch unit 4 via the motion-transmitting member 23. Even when the childproof lever 12 is in the locking position, the fully-open door latch unit 4 is released to enable the door 1 to close.

The inside handle IH3 is operated for door-closing when the door 1 is held in the fully-open position and when the motion-connecting section 5 and childproof lever 12 are in the unlocking state and locking position respectively.

When the inside handle IH3 is operated for door-closing in FIG. 14, the door-closing action is transmitted via the motion-transmitting member 22 to the crank lever 9 which is moved for releasing. Hence, the releasing action of the crank lever 9 is transmitted to the fully-open door latch unit 4 via the motion-transmitting member 23. Even when the childproof lever 12 is in the locking position, the fully-open door latch unit 4 is released to enable the door 1 to close.

The outside handle OH is operated when the door 1 is held in the fully-open position and when the motion-connecting section 5 and childproof lever in the locking state and locking position respectively.

When the outside handle OH is operated in FIG. 15, the action of the outside handle OH is transmitted to the outside lever 7 via the motion-transmitting member 17. The releasing action of the outside lever 7 is transmitted to the crank lever 9 via the pushing portion 73 and pushed portion 93. The releasing action of the crank lever 9 is transmitted to the fully-open door latch unit 4 via the motion-transmitting member 23. Even when the motion-connecting section 5 and childproof lever 12 are in the locking state and locking position respectively, the fully-open door latch unit 4 is released to enable the door 1 to close.

The inside handle IH is operated for door-closing when the door is held in the fully-open position and when the motion-connecting section 5 and childproof lever 12 are in the locking state and locking position.

When the inside handle IH3 is operated for door-closing in FIG. 15, the door-closing action is transmitted via the motion-transmitting member 22 to the crank lever 9 which is moved for releasing. The releasing action of the crank lever 9 is transmitted to the fully-open door latch unit 4 via the motion-transmitting member 23. Even when the motion-connecting section 5 and childproof lever 12 are in the locking state and locking position respectively, the full-open door latch unit 4 is released to enable the door 1 to close.

The embodiment of the present invention is described, and without departing from the scope of claims, various changes and modifications may be possible.

One or both of the sensors of the first and second detecting switches 20,30 may be exposed from the side of the housing

141. In this case, the detected portions 75 and 122 of the outside lever 17 and/or childproof lever 12 may move along the side of the housing 141.

What is claimed is:

1. An operating device for a vehicle door latch, comprising; an inside handle disposed on a door inside a vehicle, wherein the inside handle is swingable between an opening direction and a closing direction; a base member fixed to the door; an inside lever pivotally mounted to the base member and connected to the inside handle; a locking lever moving between an unlocking position for validating a releasing action of the inside lever and a locking position for invalidating the releasing action of the inside lever; a housing fixed to the base member; a motor disposed in the housing; an output lever disposed outside the housing to move the locking lever between the unlocking position and the locking position by actuation of the motor; a detected lever pivotally mounted to the housing and coupled to the inside handle so as to swing in response to the swinging of the inside handle; and an inside-handle detection switch disposed in the housing to detect an opening swinging direction of the detected lever and a closing swinging direction of the detected lever so as to enable the swinging of the inside handle to be detected; wherein the inside-handle detecting switch detects the opening and closing swinging directions of the detected lever and therefore, the opening and closing directions of the inside handle, respectively, so as to transmit a signal to control circuits to open and close the door, respectively.

2. The operating device of claim 1 wherein the detected lever is pivoted to a part of the housing facing the inside handle and engages with a connecting portion of the inside handle so that the detected lever is moved with the inside handle.

* * * * *